US011057706B2

(12) United States Patent
Yasuda et al.

(10) Patent No.: US 11,057,706 B2
(45) Date of Patent: Jul. 6, 2021

(54) SPEAKER DRIVING DEVICE

(71) Applicant: Trigence Semiconductor, Inc., Tokyo (JP)

(72) Inventors: Akira Yasuda, Tokyo (JP); Jun-ichi Okamura, Tokyo (JP); Hiroshi Iwamura, Tokyo (JP)

(73) Assignee: TRIGENCE SEMICONDUCTOR, INC., Tokyo (JP)

( * ) Notice: Subject to any disclaimer, the term of this patent is extended or adjusted under 35 U.S.C. 154(b) by 0 days.

(21) Appl. No.: 16/920,478

(22) Filed: Jul. 3, 2020

(65) Prior Publication Data

US 2020/0336834 A1 Oct. 22, 2020

Related U.S. Application Data

(63) Continuation of application No. PCT/JP2018/000028, filed on Jan. 4, 2018.

(51) Int. Cl.

| | |
|---|---|
| ***H04R 5/04*** | (2006.01) |
| ***H04R 3/12*** | (2006.01) |
| ***H04S 7/00*** | (2006.01) |

(52) U.S. Cl.

CPC ..... *H04R 5/04* (2013.01); *H04R 3/12* (2013.01); *H04S 7/30* (2013.01)

(58) Field of Classification Search

None

See application file for complete search history.

(56) References Cited

U.S. PATENT DOCUMENTS 8,306,244 B2 11/2012 Okamura et al.
8,423,165 B2 4/2013 Yasuda et al.
(Continued)

FOREIGN PATENT DOCUMENTS

JP 2008-312096 12/2008
JP 2012-055006 3/2012
(Continued)

OTHER PUBLICATIONS

Karsten Oyen, "Compensation of Loudspeaker Nonlinearities-DSP implementation", Norwegian University of Science and Technology Department of Electronics and Telecommunications, Aug. 2007, p. 21-27, http://www.diva-portal.org/smash/get/diva2:347578/FULLTEXT01.pdf, retrieved Apr. 11, 2016.
(Continued)

*Primary Examiner* — Paul W Huber
(74) *Attorney, Agent, or Firm* — Capitol IP Law Group, PLLC

(57) ABSTRACT

A speaker driving device includes a first calculation unit, a first driving signal generation unit and a third calculation unit. The first calculation unit outputs a first calculation signal obtained from a first input signal based on response characteristics according to a first parameter defining an equivalent circuit of a first speaker unit. The first driving signal generation unit generates a first driving signal based on a second driving signal and the first calculation signal. The first driving signal drives a first output speaker unit. The third calculation unit generates a third calculation signal from a second input signal based on response characteristics according to a third parameter defining an equivalent circuit of a third speaker unit. The second driving signal generation unit generates the second driving signal based on the first driving signal and the third calculation signal. The second driving signal drive a second output speaker unit.

14 Claims, 7 Drawing Sheets

(56) References Cited

U.S. PATENT DOCUMENTS

| | | | | |
|---|---|---|---|---|
| 9,219,960 | B2 | 12/2015 | Yasuda et al. | |
| 9,300,310 | B2 | 3/2016 | Yasuda et al. | |
| 2009/0262947 | A1* | 10/2009 | Karlsson | H04S 1/00 381/17 |
| 2010/0092004 | A1* | 4/2010 | Kuze | H04R 3/08 381/71.11 |
| 2010/0172505 | A1 | 7/2010 | Kimura et al. | |
| 2010/0290642 | A1* | 11/2010 | Hasegawa | H04R 29/001 381/94.1 |
| 2019/0058946 | A1 | 2/2019 | Yasuda et al. | |
| 2019/0058947 | A1 | 2/2019 | Yasuda et al. | |

FOREIGN PATENT DOCUMENTS

| | | |
|---|---|---|
| JP | 2013-110633 | 6/2013 |
| WO | 2017/179538 | 10/2017 |

OTHER PUBLICATIONS

Internal Search Report dated Mar. 13, 2018, issued in International Patent Application No. PCT/JP2018/000028.

Karsten Oyen, "Compensation of Loudspeaker Nonlinearities-DSP implementation", Norwegian University of Science and Technology Department of Electronics and Telecommunications, Aug. 2007, p. 21-27, http://www.diva-portal.org/smash/get/diva2:347578/FULLTEXT01.pdf.

Written Opinion of the International Searching Authority dated Mar. 13, 2018, issued in International Patent Application No. PCT/JP2018/000028.

* cited by examiner

| Template | Parameter | | |
|---|---|---|---|
| | A | B | ‥ |
| AAA | a1 | b1 | ··· |
| BBB | a2 | b2 | ··· |
| CCC | a3 | b3 | ··· |
| ⋮ | ⋮ | ⋮ | ⋱ |

SPEAKER DRIVING DEVICE

CROSS-REFERENCE TO RELATED APPLICATION

This application is a Continuation of International Patent Application No. PCT/JP2018/000028, filed on Jan. 4, 2018, the disclosure of which is incorporated by reference for all purposes as if fully set forth herein.

BACKGROUND

Field

Exemplary embodiments relate to a technology for driving a speaker.

Discussion of the Background

Generally, a sound source obtained by binaural recording (binaural sound source) is reproduced by earphones to be listened to. By stereoscopically recognizing a sound image, the listener can listen to a sound having a very realistic feeling. In the listening with a speaker, unlike the listening with the earphones, a part of signal components from a Lch (left channel) speaker reaches the right ear as a crosstalk sound, and a part of the signal components from a Rch (right channel) speaker reaches the left ear as the crosstalk sound. Therefore, when the binaural sound source is reproduced by the speaker, the sound image as when the sound is listened to using the earphones cannot be obtained due to the presence of such a crosstalk sound.

Therefore, when the binaural sound source is reproduced by the speaker, it is attempted to cancel the crosstalk sound. The crosstalk sound reaches later than a direct sound because the propagation distance is longer than the direct sound. By utilizing this phenomenon, it is possible to cancel the crosstalk sound from the sound reproduced by the speaker. Specifically, a delayed sound of the Lch is subtracted from a sound reproduced from a speaker of the Rch, and a delayed sound of the Rch is subtracted from a sound reproduced from a speaker of the Lch. Thus, by canceling the crosstalk sound, it is possible to listen to the sound close to that reproduced by the earphones. A system for reproducing such a binaural sound source by the speaker is called a transaural system.

In the transaural system, various technologies have been studied besides the technology of canceling the crosstalk sound using the delayed sound signal as described above. As an example of such a technology, a technology for removing spatial crosstalk components by using a transfer function from a speaker to the right ear and a transfer function from a speaker to the left ear is disclosed in the Patent Literature 1 (Japanese laid-open patent publication No. 2013-110633).

The above information disclosed in this Background section is only for enhancement of understanding of the background of the inventive concept, and, therefore, it may contain information that does not form the prior art that is already known in this country to a person of ordinary skill in the art.

SUMMARY

According to an exemplary embodiment, there is provided a speaker driving device including: a first calculation unit for outputting a first calculation signal obtained from a first input signal based on response characteristics according to a first parameter, the first parameter defining an equivalent circuit of a first speaker unit; a first driving signal generation unit for generating a first driving signal based on a second driving signal and the first calculation signal, the first driving signal for driving a first output speaker unit; a third calculation unit for generating a third calculation signal from a second input signal based on response characteristics according to a third parameter, the third parameter defining an equivalent circuit of a third speaker unit; and a second driving signal generation unit for generating the second driving signal based on the first driving signal and the third calculation signal, the second driving signal for driving a second output speaker unit.

According to an exemplary embodiment, there is provided a speaker driving device including: a first calculation unit for outputting a first calculation signal obtained from a first input signal based on response characteristics according to a first parameter, the first parameter defining an equivalent circuit of a first speaker unit; a first driving signal generation unit for generating a second calculation signal and a first driving signal based on a fourth calculation signal and the first calculation signal, the first driving signal for driving a first output speaker unit, the second calculation signal including a characteristic value corresponding to the first calculation signal; a third calculation unit for generating a third calculation signal from a second input signal based on response characteristics according to a third parameter, the third parameter defining an equivalent circuit of a third speaker unit; and a second driving signal generation unit for generating the fourth calculation signal and a second driving signal based on the second calculation signal and the third calculation signal, the second driving signal for driving a second output speaker unit, the fourth calculation signal including a characteristic value corresponding to the third calculation signal.

The foregoing general description and the following detailed description are exemplary and explanatory and are intended to provide further explanation of the claimed subject matter.

DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF EXEMPLARY EMBODIMENTS

Figure 1:
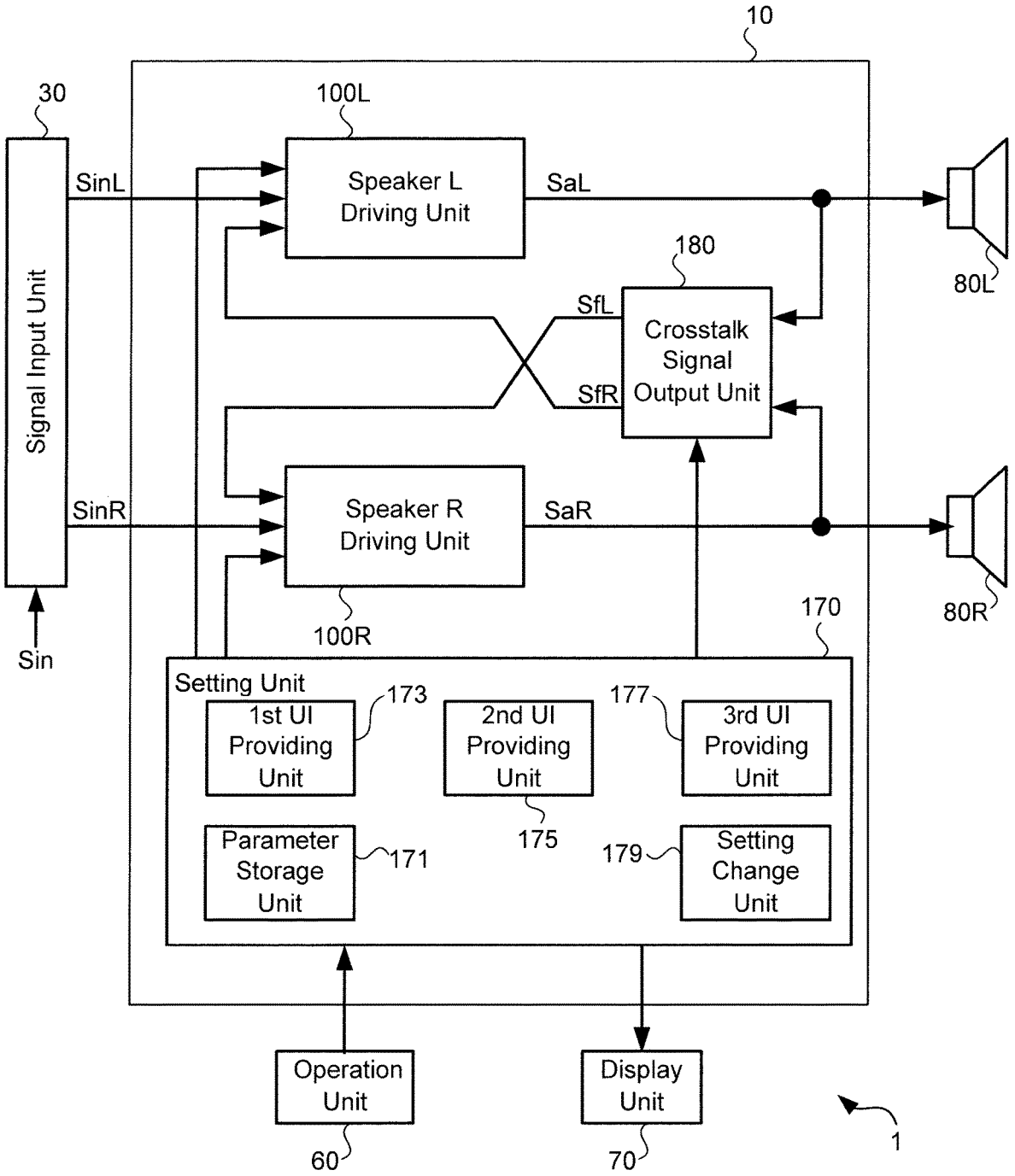
FIG. 1 is a block diagram showing a function of a speaker device according to a first embodiment.

Hereinafter, a speaker device according to an exemplary embodiment of the present disclosure will be described in detail with referring to the drawings. The following embodiments are examples of embodiments of the present disclosure, and the present inventive concept is not to be construed as being limited to these exemplary embodiments. That is, it is possible to implement the present inventive concept in various modes by applying a known technology to a plurality of exemplary embodiments described below to make modifications. In the drawings referred to in the present exemplary embodiments, the same portions or portions having similar functions are denoted by the same reference numerals or similar reference numerals (only A, B, etc. are denoted after numerals), and a repetitive description thereof may be omitted.

First Embodiment

[1. Brief Overview of Speaker Equipment]

FIG. 1 is a block diagram showing a function of a speaker device according to the first embodiment. A speaker device 1 comprises a speaker driving device 10, a signal input unit 30, an operation unit 60, a display unit 70 and speaker units 80L, 80R.

The signal input unit 30 includes a terminal to which an audio signal Sin is supplied, and inputs the supplied audio signal Sin separated for each channel to the speaker driving device 10. In this example, the audio signal Sin is a 2ch signal, and the signal input unit 30 inputs the audio signal Sin to the speaker driving device 10 by separating the audio signal Sin into a Lch audio signal SinL (first input signal) and a Rch audio signal SinR (second input signal). In the following description, reference numerals L and R indicate structure corresponding to the Lch and the Rch, respectively. The audio signal Sin may be supplied to the signal input unit 30 by being received by the signal input unit 30 from an external device such as a server via a network.

The speaker driving device 10, in response to an input of the audio signals SinL, SinR, outputs an Lch driving output signal SaL (first driving signal) for driving the speaker unit 80L and a Rch driving output signal SaR (second driving signal) for driving the speaker unit 80R. Structures of the speaker driving device 10 will be described later.

The speaker unit 80L (second speaker unit) outputs a sound corresponding to the Lch driving output signal SaL supplied from the speaker driving device 10. The speaker unit 80R (fourth speaker unit) outputs a sound corresponding to the Rch driving output signal SaR supplied from the speaker driving device 10. In the speaker device 1, it is possible to output not only a sound corresponding to the characteristics of the speaker units 80L, 80R, but also a sound simulating a speaker unit (hereinafter sometimes referred to as a target speaker unit) having a characteristic that differs from the characteristics of the speaker units 80L, 80R. In this example, it is preferable that the speaker unit 80L and the speaker unit 80R have, but not limited to, the same characteristics.

The operation unit 60 is a device for receiving operations input by a user, such as a touch sensor, a keyboard, and a mouse, and outputs operation signals corresponding to the input operations to the speaker driving device 10. The display unit 70 is a display device such as a liquid crystal display and an organic EL display, and displays a screen based on a control of the speaker driving device 10. The operation unit 60 and the display unit 70 may be integrated to form a touch panel.

Technologies using a head-related transfer function allow highly accurate reproduction but greatly limiting the listener's position and orientation. Therefore, in order to maintain a state with high accuracy, it is necessary to use a complicated configuration as in the technology disclosed in Patent Literature 1 described above. The head-related transfer function is complex and varies widely among individuals. Therefore, an approximation processing is necessary in order to provide versatility so as to cope with various people. As a result, the accuracy had to be lowered.

On the other hand, according to the technology of canceling the crosstalk sound using the delayed sound signal as described above, there is little limitation on the position of the listener concerning the left and right sound image localization. On the other hand, the processing of canceling such a crosstalk sound by the correlation between the sound of Lch and the sound of Rch functions as a high-pass filter. As a result, in particular in the sound localized in the vicinity of the center is greatly reduced bass, a problem that the sound quality is changed occurs.

According to an embodiment of the present inventive concept, it is possible to realize a sound image localization close to that of the reproduction by the earphones in a wide listening range while suppressing the change in the sound quality due to canceling the crosstalk sound. Hereinafter, the structure of the speaker driving device 10 will be described in detail.

[2. Speaker Driving Device]

As shown in FIG. 1, the speaker driving device 10 includes a speaker L driving unit 100L, a speaker R driving unit 100R, a setting unit 170, and a crosstalk signal output unit 180. The audio signal SinL and a Rch crosstalk signal SfR (fourth driving signal) are input to the speaker L driving unit 100L, and based on these signals, the speaker L driving unit 100L outputs the Lch driving output signal SaL. The audio signal SinR and a Lch crosstalk signal SfL (third driving signal) are input to the speaker R driving unit 100R, and based on these signals, the speaker R driving unit 100R outputs the Rch driving output signal SaR. The Lch crosstalk signal SfL and the Rch crosstalk signal SfR are signals that are output from the crosstalk signal output unit 180 by performing a predetermined calculation processing on the Lch driving output signal SaL and the Rch driving output signal SaR.

[2-1. Crosstalk Signal Output Unit]

Figure 2:
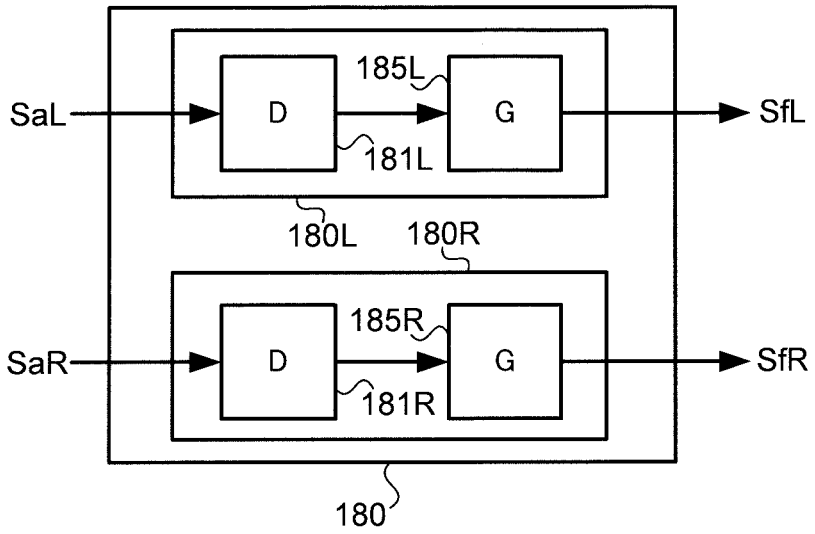
FIG. 2 is a block diagram showing a function of a crosstalk signal output unit according to the first embodiment.

FIG. 2 is a block diagram showing a function of the crosstalk signal output unit according to the first embodiment. The crosstalk signal output unit 180 includes a Lch signal processing unit 180L (fifth calculation unit) and a Rch signal processing unit 180R (sixth calculation unit).

The Lch signal processing unit 180L performs a calculation processing (first calculation processing) on the Lch driving output signal SaL to cancel a crosstalk sound, and outputs the signal as the Lch crosstalk signal SfL. The calculation processing includes a delay processing with a set delay time and an amplification processing with a set amplification factor (attenuation processing to attenuate a signal level in this example). The delay processing is performed in a delay device 181L. The amplification processing is performed in an amplifier 185L.

The Rch signal processing unit 180R performs a calculation processing (second calculation processing) on the Rch driving output signal SaR to generate a crosstalk signal, and outputs the signal as the Rch crosstalk signal SfR. The calculation processing includes the delay processing with a set delay time and the amplification processing with a set amplification factor (attenuation processing to attenuate a signal level in this example). The delay processing is performed in a delay device 181R. The amplification processing is performed in an amplifier 185R.

[2-2. Speaker L Driving Unit]

Figure 3A:
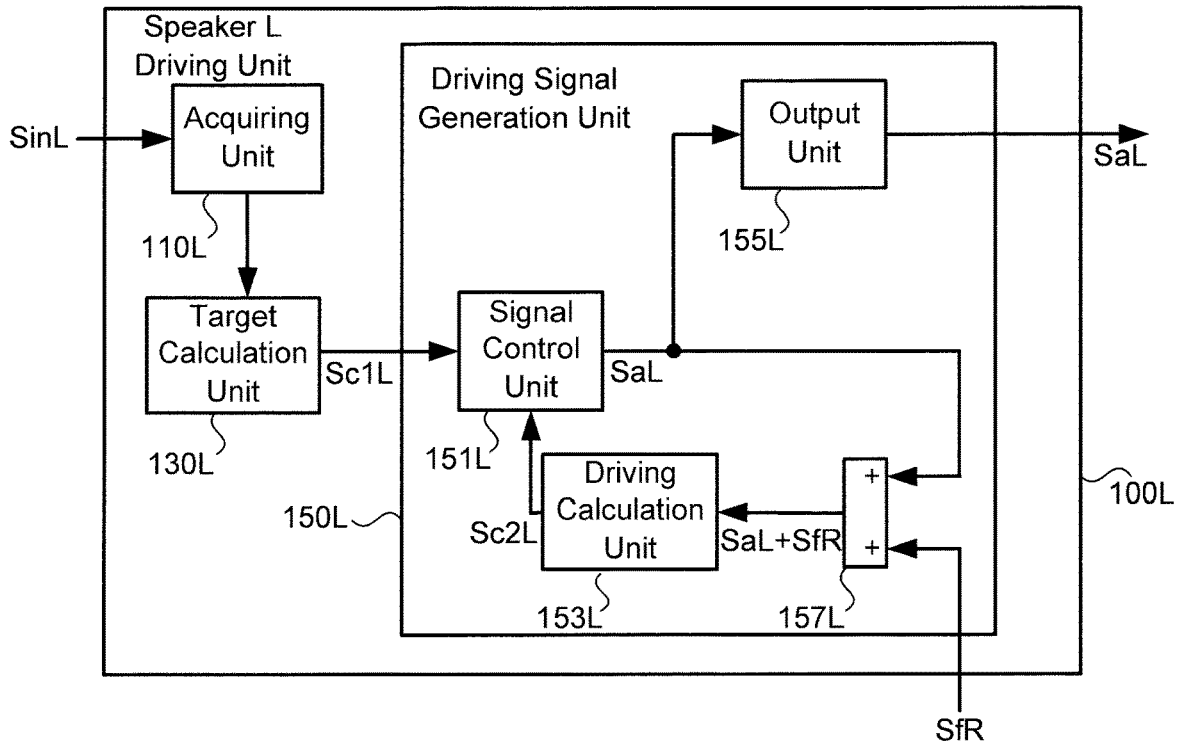
FIG. 3A is a block diagram showing a function of a speaker L driving unit according to the first embodiment.

FIG. 3A is a block diagram showing a function of the speaker L driving unit according to the first embodiment. The speaker L driving unit 100L includes an acquiring unit 110L, a target calculation unit 130L (first calculation unit), and a driving signal generation unit 150L (first driving signal generation unit). The acquiring unit 110L acquires the audio signal SinL supplied from the signal input unit 30 as the input signal.

[2-2-1. Target Calculation Unit]

The target calculation unit 130L uses the audio signal SinL acquired by the acquiring unit 110L to perform a calculation by an electro-mechanical model of the speaker unit, and outputs an Lch target calculation signal Sc1L (first calculation signal) indicating the calculation result. This speaker unit is not the speaker unit 80L described above, but the target speaker unit of the Lch (first speaker unit). The calculation performed by the target calculation unit 130L is a calculation for obtaining a characteristic value indicating the operation (inner state) of the target speaker unit with the audio signal SinL as the input signal by using a parameter specifying the structure of the target speaker unit.

The characteristic value that indicates the operation of the target speaker unit is, in this example, the temporal change in the position of a diaphragm. Therefore, in this example, the Lch target calculation signal Sc1L corresponds to the position of the diaphragm of the target speaker unit. In this manner, the target calculation unit 130L applies frequency characteristics (response characteristics) corresponding to the target speaker unit to the audio signal SinL. This parameter may not be a value directly specify the structure but maybe a parameter indicating characteristics according to the structure of the speaker unit. Hereinafter, a parameter to be set to use in the target calculation unit 130L is, that is, a parameter to specify the structure of the target speaker unit, referred to as an Lch target speaker parameter (first parameter).

The Lch target speaker parameter is, for example, at least one of the parameters (sometimes referred to as a TS-parameter) defining an equivalent circuit of the target speaker unit (or the respective structures comprising it). The parameter is, for example, mechanical constants such as mass, damper spring constant, magnetic flux density, inductance, stiffness, and mechanical resistance. The Lch target speaker parameter may be a damping factor, a resonant frequency, or the like that can be calculated by combining these parameters. The Lch target speaker parameter may be the characteristics in the time-domain, or a value that controls it, etc. The Lch target speaker parameter may be a value for calculating the position (or velocity) of the diaphragm of the target speaker unit, a maximal value of the position of the diaphragm, impulse response characteristics of the diaphragm, step response characteristics of the diaphragm, impulse response characteristics of the position of the diaphragm, step response characteristics of the position of the diaphragm, etc. The Lch target speaker parameter may be characteristics of the reproduced sound pressure rather than the characteristics related to the diaphragm described above. In any case, it is sufficient if the parameter affects the position of the diaphragm of the target speaker unit by the calculation rather than the parameter (center frequency, Q, cutoff gain) on the simple frequency domain.

Specific examples of the parameter defining the equivalent circuit of this speaker unit are exemplified in WO 2017/179538, and therefore detailed descriptions thereof are omitted. A Rch target speaker parameter (third parameter) corresponding to the target speaker unit (third speaker unit) of the Rch, a Lch driving speaker parameter (the second parameter), and a Rch driving speaker parameter (the fourth parameter), which will be described later, are also the same as the Lch target speaker parameter.

The Lch target calculation signal Sc1L is the characteristic value corresponding to the position of the diaphragm of the target speaker unit, but it is sufficient that the Lch target calculation signal Sc1L is the characteristic value corresponding to the information related to this position. The information related to the position may be, for example, the velocity of the diaphragm, the current, or the like. The characteristic value may be vector information (e.g., position of the diaphragm, current) that includes information about a plurality of properties. The calculation in the target calculation unit 130L used the electro-mechanical model of the target speaker unit but may also use an acoustical (radiating property) model or a spatially propagating model. In this case, the Lch target calculation signal Sc1L is not intended to indicate the position of the diaphragm of the target speaker unit, may be such as to indicate the oscillation of the air at a predetermined position. Even in this case, it can be said that the calculation result related to the position of the diaphragm. The model used for the calculation may include not only linear characteristics but also the calculation related to nonlinear characteristics.

As a specific content of the model used for the above calculation, any known calculation methods can be applied. As the known calculation method, it is exemplified in the following literature.

Karsten Oyen, "Compensation of Loudspeaker Nonlinearities-DSP implementation", [online], Master of Science in Electronics, Norwegian University of Science and Technology Department of Electronics and Telecommunications, August 2007, p. 21-27, [Search Apr. 11, 2016], Internet <URL:http://www.diva-portal.org/smash/get/diva2:347578/FULLTEXT01.pdf>

[2-2-2. Driving Signal Generation Unit]

The driving signal generation unit 150L includes a signal control unit 151L (first signal control unit), a driving calculation unit 153L (second calculation unit), an output unit 155L, and an adder 157L. The Lch target calculation signal Sc1L and a Lch driving calculation signal Sc2L (second calculation signal) are input to the signal control unit 151L, and the signal control unit 151L outputs the Lch driving output signal SaL to the adder 157L and the output unit 155L. The Lch driving output signal SaL is generated and output so that the Lch target calculation signal Sc1L and the Lch driving calculation signal Sc2L match each other. The Lch driving calculation signal Sc2L is a signal generated in the driving calculation unit 153L based on the Lch driving output signal SaL and the Rch crosstalk signal SfR. The Lch driving calculation signal Sc2L will be described later.

The output unit 155L outputs the acquired Lch driving output signal SaL to the speaker unit 80L. In this example, the output unit 155L is a terminal to which the speaker unit 80L is connected. The output unit 155L may transmit the Lch driving output signal SaL to the external device via the network. The output unit 155L may adjust the dynamic range of the Lch driving output signal SaL or amplify the Lch driving output signal SaL to output the signal to the speaker unit 80L. The output level of the Lch driving output signal SaL acquired as described above, depending on the content of the calculation, may be increased in comparison with that of the audio signal SinL. In such case, the Lch driving output signal SaL may be a signal with a compressed dynamic range.

The adder 157L outputs a synthesized signal obtained by adding the Lch driving output signal SaL output from the signal control unit 151L and the Rch crosstalk signal SfR to the driving calculation unit 153L. As described above, the Rch crosstalk signal SfR is a signal supplied from the crosstalk signal output unit 180 based on the Rch driving output signal SaR output from the speaker R driving unit 100R. More specifically, the Rch crosstalk signal SfR is a signal obtained by performing the delay processing and the attenuation processing on the Rch driving output signal SaR, and is a signal which simulates the crosstalk sound when the sound of Rch reaches the left ear.

The driving calculation unit 153L performs the calculation by the electro-mechanical model of the speaker unit using the synthesized signal (the Lch driving output signal SaL+the Rch crosstalk signal SfR) output from the adder 157L as the input signal, and outputs the Lch driving calculation signal Sc2L indicating the result of the calculation. This speaker unit is hereinafter referred to as a driving speaker unit. The calculation performed by the driving calculation unit 153L is the calculation for obtaining the characteristic value indicating the operation of the driving speaker unit with the synthesized signal (the Lch driving output signal SaL+the Rch crosstalk signal SfR) as the input signal using a parameter specifying the structure of the driving speaker unit.

The characteristic value that indicates the operation of the driving speaker unit is, in this example, the temporal change in the position of the diaphragm. Therefore, in this example, the Lch driving calculation signal Sc2L corresponds to the position of the diaphragm of the driving speaker unit. In this manner, the driving calculation unit 153L applies the frequency characteristics (response characteristics) corresponding to the driving speaker unit to the input signal. The Lch target calculation signal Sc1L and the Lch driving calculation signal Sc2L basically indicate the temporal change of the same physical quantity. This parameter may not be a value directly specify the structure as in the case of the target calculation unit 130L, and maybe a parameter indicating the characteristics according to the structure of the speaker unit. Hereinafter, a parameter to be set to use in the driving calculation unit 153L is, that is, a parameter to specify the structure of the driving speaker unit is referred to as the Lch driving speaker parameter.

The driving speaker unit is intended to assume the speaker unit 80L described above. Therefore, the Lch driving speaker parameter is a value related to the speaker unit 80L. As will be described later, by such a setting, it is possible to make the sound output from the speaker unit 80L closer to the sound of the target speaker unit. The Lch driving speaker parameter may be set with the driving speaker unit as a speaker unit other than the speaker unit 80L, intended to provide various unintentional acoustic effects that differ from the sound of the target speaker unit.

Since the Lch driving speaker parameter is exemplified by the same content as the Lch target speaker parameter described above, the description thereof will be omitted. The calculation in the driving calculation unit 153L may be performed using the same model as that in the target calculation unit 130L. The calculation processing in the target calculation unit 130L and the calculation processing in the driving calculation unit 153L are the same model used for the calculation processing. Though these calculation processing do not need to use the same model, it is preferable that the characteristic value included in the Lch driving calculation signal Sc2L and that included in the Lch target calculation signal Sc1L relate to each other to facilitate the comparisons in the signal control unit 151. For example, it is preferable that the signals indicate the temporal change of the same physical quantity as each other. Like the Lch target calculation signal Sc1L, the Lch driving calculation signal Sc2L may include a value corresponding to the information related to the position of the diaphragm, not limited to the position of the diaphragm.

As described above, the driving calculation unit 153L uses the synthesized signal output from the adder 157L as the input signal. That is, not only the Lch driving output signal SaL output from the output unit 155L but also the synthesized signal obtained by further adding the Rch crosstalk signal SfR are input to the driving calculation unit 153L. Therefore, it can be said that the driving calculation unit 153L and the adder 157L perform the calculation processing for generating the crosstalk signal.

The signal control unit 151L outputs the Lch driving output signal SaL so that the Lch target calculation signal Sc1L and the Lch driving calculation signal Sc2L match each other. For the generation of the Lch driving output signal SaL, a technology of general feedback control (PID control, optimal control, application control, etc.) may be used, or the same technology as the control of a digital power supply may be used. The feedback gain set in the feedback control may be updated according to the values of the Lch driving speaker parameter when the Lch driving speaker parameter set in the driving calculation unit 153L is changed. At this time, the feedback gain may be set to a value determined in advance according to the Lch driving speaker parameter to be set, or a value acquired by a function that automatically calculates an appropriate value according to the Lch driving speaker parameter. As a result, the Lch driving output signal SaL is output so that the Lch driving calculation signal Sc2L corresponding to the driving speaker unit and the Lch target calculation signal Sc1L corresponding to the target speaker unit match each other.

When this Lch driving output signal SaL is supplied to the actual driving speaker unit, the driving speaker unit (in this example, the speaker unit 80L) can be driven in the same manner as when the target speaker unit is driven by the audio signal SinL. Furthermore, the driving speaker unit can be driven by the Lch driving output signal SaL including a signal for canceling the crosstalk sound of the Rch. Therefore, when the Lch driving speaker parameter is specified by the property of the speaker unit 80L, a sound obtained by synthesizing the sound when the audio signal SinL is output using the target speaker unit and the sound for canceling the crosstalk sound is reproduced from the speaker unit 80L.

[2-3. Speaker R Driving Unit]

Figure 3B:
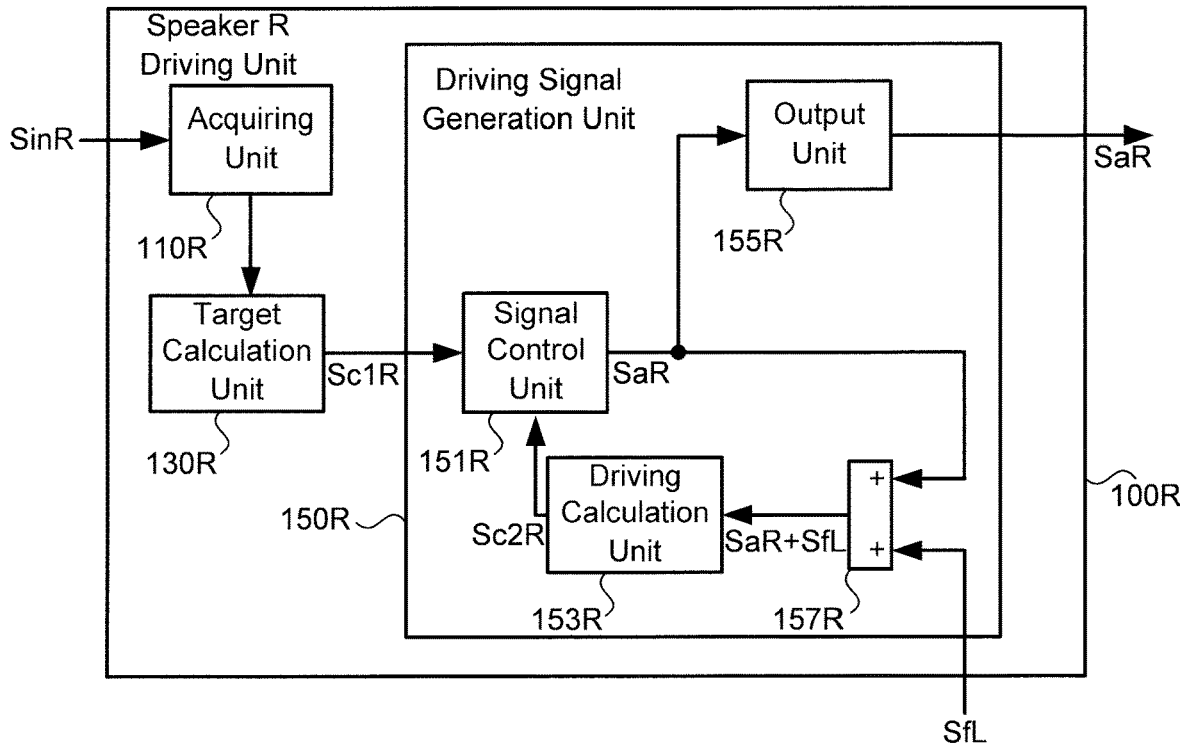
FIG. 3B is a block diagram showing a function of a speaker R driving unit according to the first embodiment.

FIG. 3B is a block diagram showing a function of the speaker R driving unit according to the first embodiment. The speaker R driving unit 100R includes an acquiring unit 110R, a target calculation unit 130R (third calculation unit), and a driving signal generation unit 150R (second driving signal generation unit). The driving signal generation unit 150R includes a signal control unit 151R (second signal control unit), a driving calculation unit 153R (fourth calculation unit), an output unit 155R, and an adder 157R. The acquiring unit 110R, the target calculation unit 130R, and the driving signal generation unit 150R operate in the same manner as the acquiring unit 110L, the target calculation unit 130L, and the driving signal generation unit 150L in the speaker L driving unit 100L, respectively. Each configuration of the driving signal generation unit 150R operates in the same manner as each configuration of the driving signal generation unit 150L. Therefore, the detailed description is omitted. The difference between the speaker L driving unit 100L and the speaker R driving unit 100R is that the input signals are different. Specifically, it is as follows.

The acquiring unit 110R acquires the audio signal SinR supplied from the signal input unit 30 as the input signal. A Rch target calculation signal Sc1R (third calculation signal) and a Rch driving calculation signal Sc2R (fourth calculation signal) are input to the signal control unit 151R, and the signal control unit 151R generates and outputs the Rch driving output signal SaR. The Rch driving output signal SaR and the Lch crosstalk signal SfL are input to the adder 157R, and the adder 157R outputs the synthesized signal obtained by adding these signals. As described above, the Lch crosstalk signal SfL is a signal supplied from the crosstalk signal output unit 180 based on the Lch driving output signal SaL output from the speaker L driving unit 100L. More specifically, the Lch crosstalk signal SfL is a signal obtained by performing the delay processing and the attenuation processing on the Lch driving output signal SaL, and is a signal which simulates the crosstalk sound when the sound of the Lch reaches the right ear.

The driving calculation unit 153R performs a calculation by the electro-mechanical model of the speaker unit using the synthesized signal output from the adder 157R as the input signal, and outputs the Rch driving calculation signal Sc2R indicating the result of the calculation. The output unit 155R outputs the acquired Rch driving output signal SaR to the speaker unit 80R.

The Rch target speaker parameter (third parameter) corresponding to the target speaker unit is set in the target calculation unit 130R. The Rch driving speaker parameter (fourth parameter) corresponding to the speaker unit 80R is set in the driving calculation unit 153R. In this example, the Rch target speaker parameter is the same as the Lch target speaker parameter, and the Rch driving speaker parameter is the same as the Lch driving speaker parameter.

When this Rch driving output signal SaR is supplied to the actual driving speaker unit, the driving speaker unit (in this example, the speaker unit 80R) can be driven in the same manner as when the target speaker unit is driven by the audio signal SinR. Furthermore, the driving speaker unit can be driven by the Rch driving output signal SaR including a signal to cancel the crosstalk sound of the Lch. Therefore, if the Rch driving speaker parameter is specified by the property of the speaker unit 80R, a sound acquired by synthesizing the sound when the audio signal SinR is output using the target speaker unit and the sound for canceling the crosstalk sound is reproduced from the speaker unit 80R.

As described above, the sound corresponding to the Lch driving output signal SaL output from the speaker L driving unit 100L is output from the speaker unit 80L, and the sound corresponding to the Rch driving output signal SaR output from the speaker R driving unit 100R is output from the speaker unit 80R. As a result, the crosstalk sound reaching the right ear of the listener from the speaker unit 80L is canceled by the components (corresponding to the Lch crosstalk signal SfL) included in the sound output from the speaker unit 80R. The crosstalk sound reaching the left ear of the listener from the speaker unit 80R is canceled by the components (correspond to the Rch crosstalk signal SfR) included in the sound output from the speaker unit 80L.

In the conventional transaural system, the delayed sound of the Lch is subtracted from the sound reproduced from the speaker of the Rch, and the delayed sound of the Rch is subtracted from the sound reproduced from the speaker of the Lch. In this case, as described above, the sound quality may change. On the other hand, according to the speaker driving device 10 of the first embodiment of the present inventive concept, as exemplified by the above-mentioned configuration, by introducing the components for canceling the crosstalk sound according to the movement of the diaphragm of the speaker unit, it is possible to suppress the change of the frequency characteristics. Therefore, according to the speaker driving device 10, while suppressing the change in sound quality than when using the conventional transaural system, the effect of canceling the crosstalk in a wide listening range is obtained, and the separated localization close to that of the reproduction by the earphones can be felt.

[2-4. Setting Unit]

Next, the setting unit 170 will be described. The setting unit 170 may not be included in the speaker driving device 10. In this case, the above-described Lch target speaker parameter, the Rch target speaker parameter, the Lch driving speaker parameter, the Rch driving speaker parameter, the delay time, and the amplification factor may be set to predetermined values, or may be set by an instruction from the external device or the like.

The setting unit 170 includes a parameter storage unit 171, a first UI providing unit 173, a second UI providing unit 175, a third UI providing unit 177, and a setting change unit 179. The above parameters may be specified by the setting unit 170. The parameter storage unit 171 stores a template table.

Figures 4, 5:
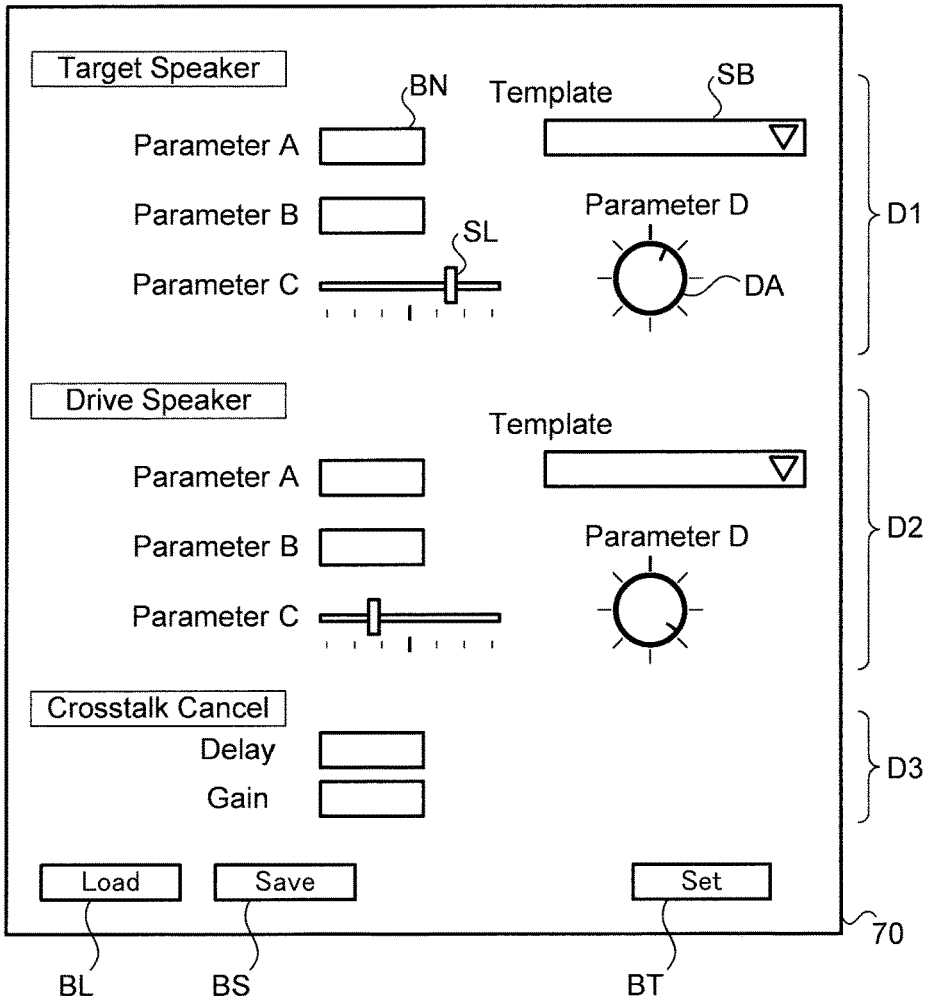
FIG. 4 is a diagram illustrating a template table according to the first embodiment.
FIG. 5 is a diagram illustrating user interface according to the first embodiment.

FIG. 4 is a diagram illustrating a template table according to the first embodiment. The template table defines combinations of parameters to be set as the Lch target speaker parameter, the Rch target speaker parameter, the Lch driving speaker parameter, and the Rch driving speaker parameter. In the example shown in FIG. 4, the template "AAA" defines a combination that the parameter A is "a1", the parameter B is "b1", . . . . For example, "AAA" is information corresponding to a model number of the speaker unit. The combination of parameters defined by the template "AAA" is the values of the parameters corresponding to the speaker unit of the model number. In this example, the parameters A, B, . . . become the Lch target speaker parameters, for example, when they are set in the target calculation unit 130L as the parameters of the target speaker unit. On the other hand, these parameters A, B, . . . become the Lch driving speaker parameters when they are set in the driving calculation unit 153L as the parameters of the driving speaker unit.

Returning to FIG. 1, the description will be continued. The first UI providing unit 173 provides a user interface for specifying the Lch target speaker parameter to be set in the target calculation unit 130L and the Rch target speaker parameter to be set in the target calculation unit 130R. The second UI providing unit 175 provides a user interface for specifying the Lch driving speaker parameter to be set in the driving calculation unit 153L and the Rch driving speaker parameter to be set in the driving calculation unit 153R. The third UI providing unit 177 provides a user interface for specifying the parameters (the delay time, the amplification factor) to be set in the crosstalk signal output unit 180. These user interfaces are realized by displaying the display unit 70 and receiving operations to be input from the operation unit 60.

FIG. 5 is a diagram illustrating the user interface according to the first embodiment. As shown in FIG. 5, in the display unit 70, a first user interface D1, a second user interface D2, and a third user interface D3 are displayed.

The first user interface D1 is a region for specifying parameters related to the target speaker unit (the Lch target speaker parameter, the Rch target speaker parameter). The second user interface D2 is a region for specifying a parameter related to the driving speaker unit (the Lch driving speaker parameter, the Rch driving speaker parameter). The third user interface D3 is a region for specifying the delay times (Delay) to be set to the delay devices 181L and 181R, and the amplification factors (Gain) to be set to the amplifiers 185L and 185R.

These parameters are specified, for example, by entering a numeric value using an entered box BN, a slider SL, or a dial DA. The selection box SB is an interface that can select a template defined in the template table. When the template is selected using the selection box SB, the parameters corresponding to the template are read from the template table and automatically entered. The read value can also be modified. A predetermined value, such as a recommended value, may be entered in advance before the parameter corresponding to the template is read.

This example shows the case where the same parameters are set for both the Lch and the Rch. Different parameters may be set for each of Lch and Rch. In this case, the user interface for the Lch and the user interface for the Rch may be provided in the same screen at the same time or may be switched by a tab or the like.

In the user interface, it may be possible to enter information assuming degradation of the speaker unit. For example, by entering the period of use (e.g., on a yearly basis) of the speaker unit, the parameters to be set are modified to correct the calculation processing. For example, the calculation processing may be corrected so as to reproduce such phenomena that the longer the usage, the harder the damper. Not limited to the period of use, the user interface capable of entering correction information for correcting the calculation processing by changing the parameters such as air pressure, humidity, and the like may be presented.

Even if the speaker unit 80L and the speaker unit 80R are the speakers having the same properties, they may have differences in the characteristics due to manufacturing variations from each other, or may have differences depending on the environment in which the speaker unit is placed (such as the surrounding structure). In such cases, the Lch driving speaker parameter to be set to the driving calculation unit 153L and the Rch driving speaker parameter to be set to the driving calculation unit 153R may be corrected differently depending on the respective conditions.

A save button BS is an interface for storing the entered value corresponding to each parameter in the memory as a combination of the parameters in the same way as the template. A load button BL reads the parameters stored in the memory to enter them corresponding to the respective parameters of the first user interface D1 and the second user interface D2.

When a set button BT is operated, the setting change unit 179 changes the setting based on the entered values. Specifically, the setting of the Lch target speaker parameter in the target calculation unit 130L and the Rch target speaker parameter in the target calculation unit 130R is changed based on the values entered in the first user interface D1. The setting of the Lch driving speaker parameter in the driving calculation unit 153L and the Rch driving speaker parameter in the driving calculation unit 153R is changed based on the values entered in the second user interface D2. In addition, the settings of the delay time and the amplification factor in the crosstalk signal output unit 180 are changed based on the values entered in the third user interface D3.

The user interface shown in FIG. 5 can be used to variously change the characteristics of the sounds output from the speaker units 80L and 80R by variously changing the parameters to be set in the target calculation units 130L, 130R and the driving calculation units 153L, 153R. For example, the target speaker unit can be changed by changing the Lch target speaker parameter in the target calculation unit 130L and the Rch target speaker parameter in the target calculation unit 130R. If the speaker units 80L and 80R are switched to another speaker unit X, the Lch driving speaker parameter and the Rch driving speaker parameter can be changed to those corresponding to the speaker unit X.

The effects of canceling the crosstalk sound can be adjusted by changing the delay time and the amplification factor to be set to the crosstalk signal output unit 180. According to the above-described processing, an effect of canceling the crosstalk sound in a relatively wide listening range can be easily obtained without strict control. Therefore, the delay time and the amplification factor to be set in the crosstalk signal output unit 180 may be fixed to predetermined values. If the distance between the speaker unit 80L and the speaker unit 80R in the speaker device 1 is fixed, the delay time and the amplification factor may be determined by a value corresponding to the distance as a recommended value. For example, the longer the distance between the speaker unit, the larger the difference in the arrival time between the direct sound and the crosstalk sound, it may be set so that the delay time is increased.

As described above, the driving speaker unit may be specified by the Lch driving speaker parameter and the Rch driving speaker parameter depending on the structure other than the speaker units 80L and 80R. In this case, a sound such that the acoustic effect corresponding to the specified parameter is given to the sound when the audio signals SinL, SinR are output using the target speaker unit may be output from the speaker unit 80L, 80L. Even in this case, it is preferable that the Lch driving speaker parameter and the Rch driving speaker parameter are set corresponding to, but not limited to, the property of the same speaker unit.

Second Embodiment

In the second embodiment, a speaker device 1A using the Lch driving calculation signal Sc2L and the Rch driving calculation signal Sc2R as signals for canceling the crosstalk sound will be described. Hereinafter, among the respective configurations of the speaker device 1A, a configuration in which the content of processing differs from that of the speaker device 1 in the first embodiment will be described, and descriptions of the configuration in which similar processing is performed may be omitted. Here, a speaker driving device 10A, in particular, a speaker L driving unit 100AL, a speaker R driving unit 100AR, and a crosstalk signal output unit 180A will be described.

Figure 6:
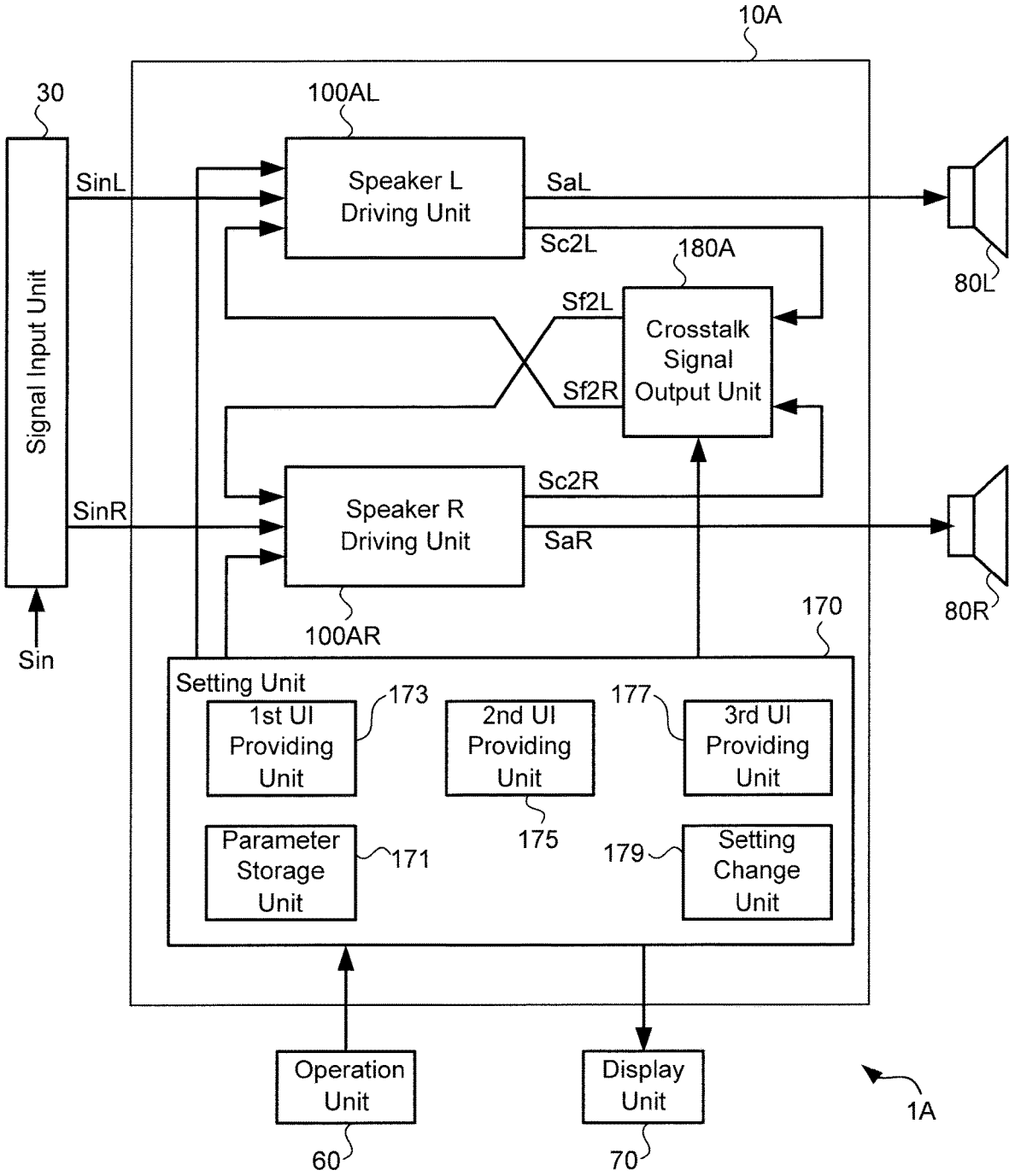
FIG. 6 is a block diagram showing a function of a speaker device according to a second embodiment.

FIG. 6 is a block diagram showing the functions of the speaker device according to a second embodiment. The speaker device 1A includes the speaker driving device 10A, the signal input unit 30, the operation unit 60, the display unit 70 and the speaker units 80L, 80R. The speaker driving device 10A includes the speaker L driving unit 100AL, the speaker R driving unit 100AR, the setting unit 170 and the crosstalk signal output unit 180A. For the signal input unit 30, the operation unit 60, the display unit 70, the speaker units 80L, 80R and the setting unit 170 in this embodiment, the same processing as the first embodiment is performed. Therefore, a description of these configurations will be omitted.

The audio signal SinL and a Rch crosstalk signal Sf2R (sixth calculation signal) are input to the speaker L driving unit 100AL, and based on these signals, the speaker L driving unit 100AL outputs the Lch driving output signal SaL and the Lch driving calculation signal Sc2L. The audio signal SinR and a Lch crosstalk signal Sf2L (fifth calculation signal) are input to the speaker R driving unit 100AR, and based on these signals, the speaker R driving unit 100AR outputs the Rch driving output signal SaR and the Rch driving calculation signal Sc2R. The Lch crosstalk signal Sf2L and the Rch crosstalk signal Sf2R are signals output from the crosstalk signal output unit 180A based on the Lch driving calculation signal Sc2L and the Rch driving calculation signal Sc2R.

The crosstalk signal output unit 180A differs from the crosstalk signal output unit 180 in the first embodiment in the signals input thereto, but does not differ greatly in the basic configuration, and is the same as the configuration shown in FIG. 2. The crosstalk signal output unit 180A performs the delay processing with a set delay time, and the amplification processing with a set amplification factor (in this example, an attenuation processing) on the Lch driving calculation signal Sc2L, and outputs the signal as the Lch crosstalk signal Sf2L. The crosstalk signal output unit 180A performs the delay processing with a set delay time, and the amplification processing with a set amplification factor (in this example, an attenuation processing) on the Rch driving calculation signal Sc2R, and outputs the signal as the Rch crosstalk signal Sf2R.

Figure 7A:
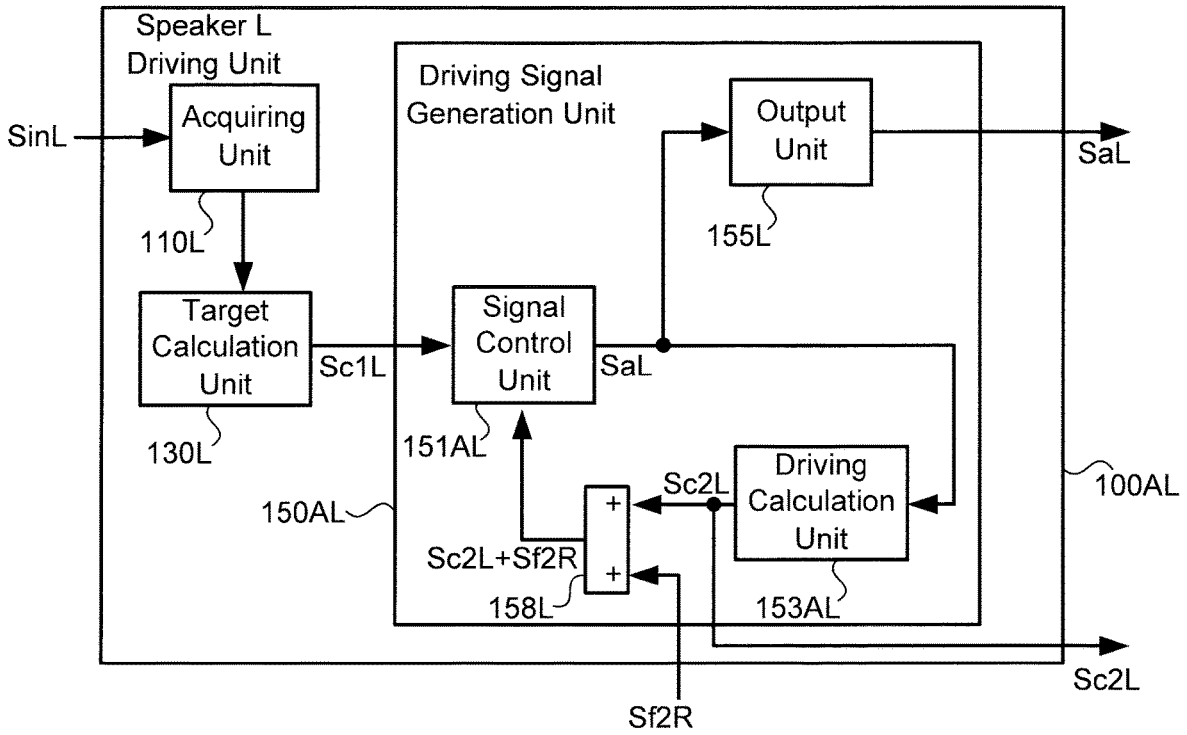
FIG. 7A is a diagram showing a function of a speaker L driving unit according to the second embodiment.

FIG. 7A is a block diagram showing a function of the speaker L driving unit according to the second embodiment. The speaker L driving unit 100AL includes the acquiring unit 110L, the target calculation unit 130L, and a driving signal generation unit 150AL. The same processing as in the first embodiment is performed to the acquiring unit 110L and the target calculation unit 130L. Therefore, a description of these configurations will be omitted. The driving signal generation unit 150AL includes a signal control unit 151AL, a driving calculation unit 153AL, the output unit 155L, and an adder 158L. The same processing as that of the first embodiment is performed to the output unit 155L. Therefore, a description of this configuration will be omitted.

The driving calculation unit 153AL is different in the input signal from the driving calculation unit 153L in the first embodiment, but the content of the calculation processing is the same. That is, the driving calculation unit 153AL performs a calculation using the Lch driving output signal SaL output from the signal control unit 151AL as the input signal, and outputs the Lch driving calculation signal Sc2L indicating the result of the calculation. This Lch driving calculation signal Sc2L is also output to the crosstalk signal output unit 180A.

The adder 158L outputs the synthesized signal obtained by adding the Lch driving calculation signal Sc2L output from the driving calculation unit 153AL and the Rch crosstalk signal Sf2R to the signal control unit 151L. As described above, the Rch crosstalk signal Sf2R is a signal supplied from the crosstalk signal output unit 180A based on the Rch driving calculation signal Sc2R output from the speaker R driving unit 100AR. More particularly, the Rch crosstalk signal Sf2R is a delayed and attenuated signal to the Rch driving calculation signal Sc2R, and a signal that the crosstalk sound when the sound of Rch reaches the left ear is indicated by the oscillation of the diaphragm of the speaker unit 80R.

As described above, the synthesized signal obtained by adding the Lch driving calculation signal Sc2L output from the driving calculation unit 153AL and the Rch crosstalk signal Sf2R in the adder 158L is input to the signal control unit 151AL. Therefore, it can be said that the driving calculation unit 153AL and the adder 158L perform the calculation processing for generating the crosstalk signals.

The signal control unit 151AL is different from the signal control unit 151L in the first embodiment in the signal to be compared with the Lch target calculation signal Sc1L. The object to be compared with the Lch target calculation signal Sc1L is not the Lch driving calculation signal Sc2L as in the first embodiment, but the synthesized signal output from the adder 158L. The first embodiment and the second embodiment are different in this respect, but the content of the processing for outputting the Lch driving output signal SaL by the signal control unit 151AL is the same. That is, the signal control unit 151AL outputs the Lch driving output signal SaL so that the synthesized signal (the Lch driving calculation signal Sc2L+the Rch crosstalk signal Sf2R) output from the adder 158L and the Lch target calculation signal Sc1L match each other.

When this Lch driving output signal SaL is supplied to the actual driving speaker unit, the driving speaker unit (in this example, the speaker unit 80L) can be driven in the same manner as when the target speaker unit is driven by the audio signal SinL. Furthermore, the driving speaker unit can be driven by the Lch driving output signal SaL including the signal for canceling the crosstalk sound of the Rch. At this time, since the Rch crosstalk signal Sf2R is added to the Lch driving calculation signal Sc2L, in order to cancel the crosstalk signal, the movement of the diaphragm of the Rch drive signal speaker unit can be reflected on the movement of the diaphragm of the Lch drive signal speaker unit. Therefore, when the Lch driving speaker parameter is specified by the property of the speaker unit 80L, a sound obtained by synthesizing the sound when the audio signal SinL is output using the target speaker unit and the sound for canceling the crosstalk sound is reproduced from the speaker unit 80L.

Figure 7B:
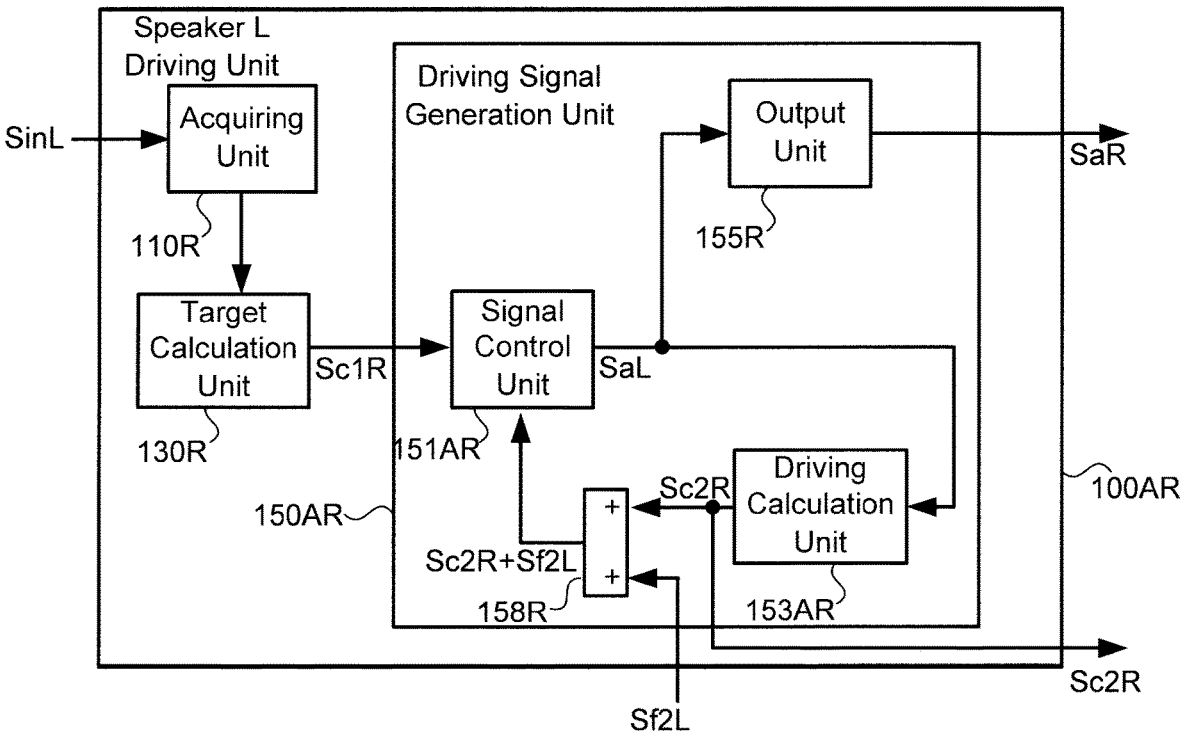
FIG. 7B is a block diagram showing a function of a speaker R driving unit according to the second embodiment.

FIG. 7B is a block diagram showing the function of the speaker R driving unit according to the second embodiment. The speaker R driving unit 100AR includes the acquiring unit 110R, the target calculation unit 130R, and a driving signal generation unit 150AR. The driving signal generation unit 150AR includes a signal control unit 151AR, a driving calculation unit 153AR, the output unit 155R, and an adder 158R. The acquiring unit 110R, the target calculation unit 130R and the driving signal generation unit 150AR perform similar operations as the acquiring unit 110L, the target calculation unit 130L and the driving signal generation unit 150AL in the speaker L driving unit 100AL, respectively. For each configuration of the driving signal generation unit 150AR, perform the same operations as for each configuration of the driving signal generation unit 150AL. Therefore, the detailed description is omitted. The difference between the speaker L driving unit 100AL and the speaker R driving unit 100AR is that the input signals are different. Specifically, it is as follows.

The acquiring unit 110R acquires the audio signal SinR supplied from the signal input unit 30 as the input signal.

The synthesized signal (the Rch driving calculation signal Sc2R+the Lch crosstalk signal Sf2L) output from the Rch target calculation signal Sc1R and the adder 158R is input to the signal control unit 151AR, and the signal control unit 151AR generates and outputs the Rch driving output signal SaR. The driving calculation unit 153AR performs a calculation using the Rch driving output signal SaR output from the signal control unit 151AR as the input signal, and outputs the Rch driving calculation signal Sc2R indicating the result of the calculation.

The Rch driving calculation signal Sc2R and the Lch crosstalk signal Sf2L are input to the adder 158R, and the adder 158R outputs the synthesized signal obtained by adding these signals. As described above, the Lch crosstalk signal Sf2L is a signal supplied from the crosstalk signal output unit 180A based on the Lch driving calculation signal Sc2L output from the speaker L driving unit 100AL. More specifically, the Lch crosstalk signal Sf2L is a signal obtained by performing the delay processing and the attenuation processing on the Lch driving calculation signal Sc2L, and a signal that the crosstalk sound when the sound of Lch reaches the right ear is indicated by the oscillation of the diaphragm of the speaker unit 80L. The output unit 155R outputs the acquired Rch driving output signal SaR to the speaker unit 80R.

When this Rch driving output signal SaR is supplied to the actual driving speaker unit, the driving speaker unit (in this example, the speaker unit 80R) can be driven in the same manner as when the target speaker unit is driven by the audio signal SinR. Furthermore, the driving speaker unit can be driven by the Rch driving output signal SaR including the signal for cancelling the crosstalk sound of the Lch. At this time, since the Lch crosstalk signal Sf2L is added to the Rch driving calculation signal Sc2R, in order to cancel the crosstalk signal, the movement of the diaphragm of the Lch drive signal speaker unit can be reflected on the movement of the diaphragm of the Rch drive signal speaker unit. Therefore, if the Rch driving speaker parameter is specified by the property of the speaker unit 80R, a sound acquired by synthesizing the sound when the audio signal SinR is output using the target speaker unit and the sound for canceling the crosstalk sound is reproduced from the speaker unit 80R.

As described above, a sound corresponding to the Lch driving output signal SaL output from the speaker L driving unit 100AL is output from the speaker unit 80L, and a sound corresponding to the Rch driving output signal SaR output from the speaker R driving unit 100AR is output from the speaker unit 80R. As the result, the crosstalk sound reaching the listener's right ear from the speaker unit 80L is canceled by the component contained in the sound output from the speaker unit 80R (the component caused by the oscillation of the diaphragm corresponding to the Lch crosstalk signal Sf2L). The crosstalk sound reaching the listener's left ear from the speaker unit 80R is canceled by the component contained in the sound output from the speaker unit 80L (the component caused by the oscillation of the diaphragm corresponding to the Rch crosstalk signal Sf2R).

According to the speaker driving device 10A of the second embodiment, as exemplified by the above configuration, by introducing components that cancel the crosstalk sound according to the movement of the diaphragm of the speaker unit, it is possible to suppress the change of the frequency characteristics. At this time, the components of the crosstalk sound are reproduced by the Lch crosstalk signal Sf2L and the Rch crosstalk signal Sf2R obtained from the Lch driving calculation signal Sc2L and the Rch driving calculation signal Sc2R corresponding to the oscillation of the diaphragm. According to this, even if the speaker unit 80L and the speaker unit 80R have different properties, it is easy to obtain the effect of canceling the crosstalk sound.

Third Embodiment

In the third embodiment, an example that the speaker device according to the above-described embodiment is implemented on software by a computer will be described. In this example, an example in which the speaker device 1 according to the first embodiment is applied to a tablet-type computer 90 will be described.

Figure 8:
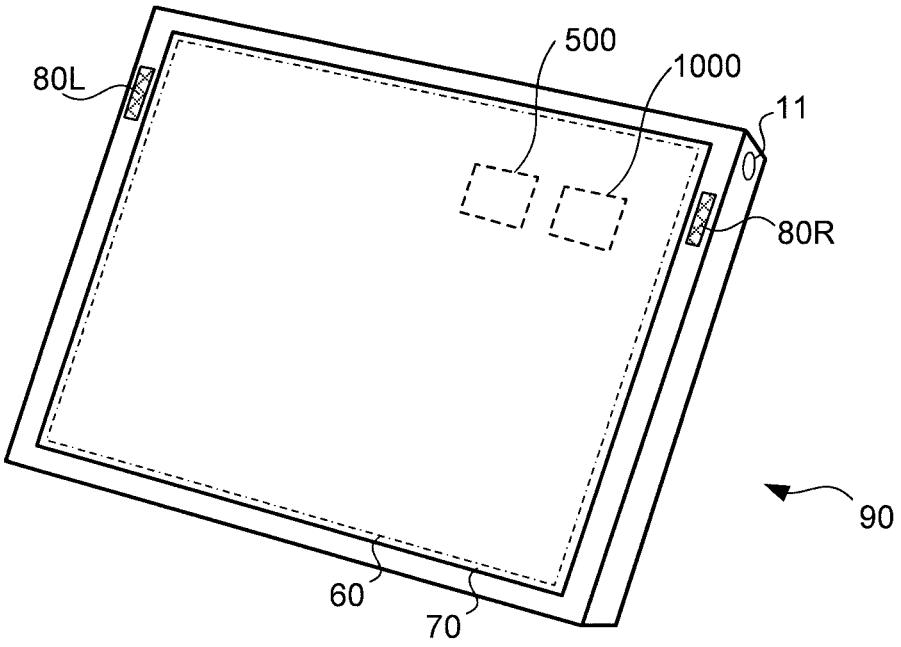
FIG. 8 is an external view showing a tablet-type computer according to a third embodiment.

FIG. 8 is an external view showing a tablet-type computer according to a third embodiment. The tablet-type computer 90 includes an input/output terminal 11, the operation unit 60, the display unit 70 and the speaker unit 80. The tablet-type computer 90 includes a control unit 1000 and a storage unit 500. The control unit 1000 includes the calculation processing circuits such as a CPU, and executes programs stored in the storage unit 500 to realize the functions of the speaker driving device 10 shown in FIG. 1 on the software. That is, the program causes the tablet-type computer 90 to function as the speaker driving device 10. The program may be installed in advance in the tablet-type computer 90 or may be acquired from an external memory or downloaded via the network.

The signal input unit 30 may acquire the audio signal Sin from the input/output terminal 11 or may acquire the audio signal Sin generated in the control unit 1000. When a headphone is connected to the input/output terminal 11, the output units 155L and 155R may output the Lch driving output signal SaL and the Rch driving output signal SaR to the input/output terminal 11 instead of the speaker units 80L and 80R. At this time, the Lch driving speaker parameter set in the driving calculation unit 153L and the Rch driving speaker parameter set in the driving calculation unit 153R may be automatically changed. The modified Lch driving speaker parameter and the Rch driving speaker parameter may be set to the equivalent of the headphone. At this time, the Lch driving speaker parameter and the Rch driving speaker parameter may not necessarily be the value corresponding to the headphone connected to the input/output terminal 11. In this example, the input/output terminal 11 shares the input terminal and the output terminal but may be provided separately from each other. The speaker driving device 10 may be configured to acquire an identification information from the headphone. In this case, the Lch driving speaker parameter set in the driving calculation unit 153L and the Rch driving speaker parameter set in the driving calculation unit 153R may be changed based on the identification information.

Although an example in which the functions of the speaker driving device are implemented by the software is described, the functions may be realized by DSP or the like.

Fourth Embodiment

In the first embodiment, the crosstalk signal output unit 180 performs the delay processing and the amplification processing for each of the Lch driving output signal SaL and the Rch driving output signal SaR to be input, and outputs the Lch crosstalk signal SfL and the Rch crosstalk signal SfR. In the fourth embodiment, by convolving a predetermined transfer function for each of the Lch driving output signal SaL and the Rch driving output signal SaR to be input, and outputs the Lch crosstalk signal SfL and the Rch crosstalk signal SfR.

Figure 9:
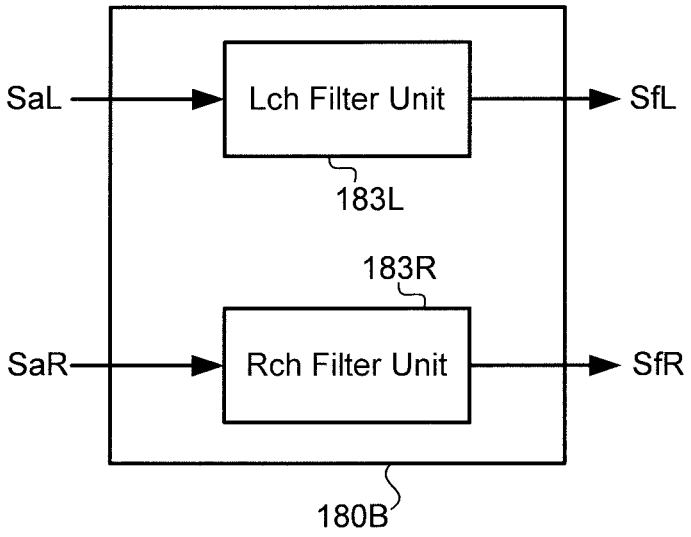
FIG. 9 is a block diagram showing a function of a crosstalk signal output unit according to a fourth embodiment.

FIG. 9 is a block diagram showing the function of the crosstalk signal output unit according to a fourth embodiment. A crosstalk signal output unit 180B includes a Lch filter unit 183L (fifth calculation unit) and a Rch filter unit 183R (sixth calculation unit). The Lch filter unit 183L performs a convolution processing on the Lch driving output signal SaL using the set transfer function, and outputs the signal as the Lch crosstalk signal SfL (third driving signal). The Rch filter unit 183R performs the convolution processing on the Rch driving output signal SaR using the set transfer function, and outputs the signal as the Rch crosstalk signal SfR (fourth driving signal). Each transfer function is, for example, the head-related transfer function. In this manner, instead of the delay processing and the amplification processing, signals for canceling the crosstalk sound may be generated by convolving predetermined transfer function.

<Modifications>

While an embodiment of the present inventive concept has been described above, each of the above-described embodiments can be applied as being mutually combined or replaced. Each of the embodiments described above may be modified as described below. In the following description, examples modified with reference to the first embodiment is shown, but may be modified with reference to other embodiments.

(1) Each function of the speaker driving device 10 may be implemented in an analog circuit or may be implemented in a digital circuit.

(2) The Lch driving output signal SaL and the Rch driving output signal SaR output from the speaker driving device 10 may be output to another device via a network.

(3) The speaker driving device 10 may be implemented in a server connected to the network. In this case, the speaker driving device 10 functioning in the server receives the audio signal Sin from a communication terminal or the like via the network, and transmits the Lch driving output signal SaL and the Rch driving output signal SaR to a device including the speaker unit or a device connectable to the device including the speaker unit via the network.

(4) The audio signal Sin may have two or more channels. It is sufficient to use a plurality of speaker driving devices 10 depending on the number of the channels. For example, the audio signal Sin may have four channels of front Lch, Rch, and rear Lch, Rch. In this case, the speaker device 1 may include the first speaker driving device 10 to which the audio signal of front Lch and Rch is supplied, and the second speaker driving device 10 to which the audio signal of rear Lch and Rch is supplied.

For example, when applying to a system given directivity by supplying out-of-phase audio signals to a plurality of speaker units, a crosstalk signal with a delay quantity equivalent to a propagation time difference from the plurality of speaker units corresponding to each channel to the inverse ear may be superimposed on a speaker model in a feedback loop in the driving signal generation unit of the other channel. For example, when the Lch and the Rch are each driven by the two speaker units (hereinafter, referred to these speaker units as L1, L2, R1, R2), a speaker L1 driving unit, a speaker L2 driving unit, a speaker R1 driving unit, and a speaker R2 driving unit are provided which output the driving output signal to the corresponding speaker unit, respectively. For example, for the Lch, the crosstalk signal may be input by any one of the following (A) to (C). The Rch is the same as the Lch.

(A) The crosstalk signal output from the speaker R1 driving unit is supplied to the speaker L1 driving unit and the crosstalk signal output from the speaker R2 driving unit is supplied to the speaker L2 driving unit.

(B) The crosstalk signal output from the speaker R2 driving unit is supplied to the speaker L1 driving unit and the crosstalk signal output from the speaker R1 driving unit is supplied to the speaker L2 driving unit.

(C) The crosstalk signal output from the speaker R1 driving unit and the crosstalk signal output from the speaker R2 driving unit are supplied to either one of the speaker L1 driving unit or the speaker L2 driving unit.

Alternatively, the Lch driving output signal SaL in the first embodiment may be phase-adjusted to be supplied to each of the L1 and the L2 speaker units, and the Rch driving output signal SaR in the first embodiment may be phase-adjusted to be supplied to each of the R1 and the R2 speaker units. Even in this case, almost the same effect as that of the first embodiment can be obtained only by changing the directivity of the sound. That is, the crosstalk sound output from the speaker unit of the R1 and the R2 can be cancelled by the sounds output from the speaker unit of the L1 and the L2 driven by the Lch driving output signal SaL. The sound output from the speaker unit of the R1 and the R2 driven by the Rch driving output signal SaR can cancel the crosstalk sound output from the speaker unit of the L1, the L2.

(5) In a digital speaker device, one speaker unit may be driven by a plurality of voice coils. In this case, the several driving output signals are used for one speaker unit. That is, the Lch driving output signal SaL and the Rch driving output signal SaR each include the number of the driving output signals corresponding to the voice coils. At this time, the driving calculation unit 153L may acquire the position of the diaphragm corresponding to the driving speaker unit by using a plurality of signals included in the Lch driving output signal SaL. Similarly, the driving calculation unit 153R may acquire the position of the diaphragm corresponding to the driving speaker unit by using the plurality of signals included in the Rch driving output signal SaR. Then, the speaker unit of the Lch is driven by the plurality of signals included in the Lch driving output signal SaL, and the speaker unit of the Rch is driven by the plurality of signals included in the Rch driving output signal SaR.

As described above, known technologies may be used for the digital speaker device that drive one speaker unit with the plurality of voice coils. As the known technologies, for example, the technologies disclosed in U.S. Pat. Nos. 8,423,165, 8,306,244, 9,219,960, and 9,300,310 can be used. This technology utilizes a noise shaper using a $\Delta\Sigma$ modulator and a mismatch shaper that selects the voice coil to which the driving signal is distributed to reduce variations.

(6) In the embodiment described above, the objects of the electro-mechanical model in the target calculation units 130L, 130R and the driving calculation units 153L, 153R and the objects driven on the basis of the electrical signals (the driving output signals SaL, SaR) were the speaker unit (the speaker units 80L, 80R), but may be any objects that can be described by differential equations, such as objects that convert the electrical signals into motion, such as the position or velocity of the machine. As the objects that can be described by differential equations, for example, electromechanical transducers such as motors, piezoelectric elements, magnetostrictive elements, electrostatic actuators, and the like are applicable to the present inventive concept. These electromechanical transducers are not limited to the case of applying to a configuration that outputs an audible sound by vibration and are also applicable as a configuration that outputs vibrations in a frequency band other than an audible sound. Therefore, the speaker driving device can be said to be an example of the driving device of the electromechanical transducer.

Although certain exemplary embodiments and implementations have been described herein, other embodiments and modifications will be apparent from this description. Accordingly, the inventive concept is not limited to such embodiments, but rather to the broader scope of the presented claims and various modifications and equivalent arrangements.

What is claimed is:

1. A speaker driving device comprising:

a first calculation unit configured to output a first calculation signal obtained from a first input signal based on response characteristics according to a first parameter, the first parameter defining an equivalent circuit of a first speaker unit;

a first driving signal generation unit configured to generate a first driving signal based on a second driving signal and the first calculation signal, the first driving signal for driving a first output speaker unit;

a third calculation unit configured to generate a third calculation signal from a second input signal based on response characteristics according to a third parameter, the third parameter defining an equivalent circuit of a third speaker unit; and a second driving signal generation unit configured to generate the second driving signal based on the first driving signal and the third calculation signal, the second driving signal for driving a second output speaker unit.

2. The speaker driving device according to claim 1, further comprising:

a fifth calculation unit configured to generate a third driving signal by a first calculation processing to the first driving signal; and a sixth calculation unit configured to generate a fourth driving signal by a second calculation processing to the second driving signal, wherein the first driving signal generation unit generates the first driving signal based on the fourth driving signal and the first calculation signal, wherein the first driving signal generation unit includes:

a second calculation unit configured to generate a second calculation signal from a signal obtained by synthesizing the first driving signal and the fourth driving signal, based on response characteristics according to a second parameter, the second parameter defining an equivalent circuit of a second speaker unit; and a first signal control unit configured to control the first driving signal based on the first calculation signal and the second calculation signal, wherein the second driving signal generation unit generates the second driving signal based on the third driving signal and the third calculation signal, and wherein the second driving signal generation unit includes:

a fourth calculation unit configured to generate a fourth calculation signal from a signal obtained by synthesizing the second driving signal and the third driving signal, based on response characteristics according to a fourth parameter, the fourth parameter defining an equivalent circuit of a fourth speaker unit; and a second signal control unit configured to control the second driving signal based on the third calculation signal and the fourth calculation signal.

3. The speaker driving device according to claim 2, wherein the first calculation processing and the second calculation processing include a delay processing and an attenuation processing.

4. The speaker driving device according to claim 2, wherein the first calculation processing and the second calculation processing include a processing for convolving a predetermined transfer function.

5. The speaker driving device according to claim 2, wherein it is possible to set so that the first parameter and the second parameter are the same.

6. The speaker driving device according to claim 2, wherein it is possible to set so that the third parameter and the fourth parameter are the same.

7. The speaker driving device according to claim 2, wherein the first calculation signal includes information related to a position of a diaphragm of the first speaker unit, the second calculation signal includes information related to a position of a diaphragm of the second speaker unit, the third calculation signal includes information related to a position of a diaphragm of the third speaker unit, and the fourth calculation signal includes information related to a position of a diaphragm of the fourth speaker unit.

8. A speaker driving device comprising:

a first calculation unit configured to output a first calculation signal obtained from a first input signal based on response characteristics according to a first parameter, the first parameter defining an equivalent circuit of a first speaker unit;

a first driving signal generation unit configured to generate a second calculation signal and a first driving signal based on a fourth calculation signal and the first calculation signal, the first driving signal for driving a first output speaker unit, the second calculation signal including a characteristic value corresponding to the first calculation signal;

a third calculation unit configured to generate a third calculation signal from a second input signal based on response characteristics according to a third parameter, the third parameter defining an equivalent circuit of a third speaker unit; and a second driving signal generation unit configured to generate the fourth calculation signal and a second driving signal based on the second calculation signal and the third calculation signal, the second driving signal for driving a second output speaker unit, the fourth calculation signal including a characteristic value corresponding to the third calculation signal.

9. The speaker driving device according to claim 8, further comprising:

a fifth calculation unit configured to generate a fifth calculation signal by a first calculation processing to the second calculation signal; and a sixth calculation unit configured to generate a sixth calculation signal by a second calculation processing to the fourth calculation signal, wherein the first driving signal generation unit generate the second calculation signal and the first driving signal based on the first calculation signal and the sixth calculation signal, wherein the first driving signal generation unit includes:

a second calculation unit configured to generate the second calculation signal from the first driving signal based on response characteristics according to a second parameter, the second parameter defining an equivalent circuit of a second speaker unit; and a first signal control unit configured to control the first driving signal based on the first calculation signal and a synthesized signal of the second calculation signal and the sixth calculation signal, wherein the second driving signal generation unit generates the fourth calculation signal and the second driving signal based on the third calculation signal and the fifth calculation signal; and wherein the second driving signal generation unit includes:

a fourth calculation unit configured to generate the fourth calculation signal from the second driving signal based on a response characteristic according to a fourth parameter, the fourth parameter defining an equivalent circuit of a fourth speaker unit; and a second signal control unit configured to control the second driving signal based on the third calculation signal and a synthesized signal of the fourth calculation signal and the fifth calculation signal.

10. The speaker driving device according to claim 9, wherein the first calculation processing and the second calculation processing include a delay processing and an attenuation processing.

11. The speaker driving device according to claim 9, wherein the first calculation processing and the second calculation processing include a processing for convolving a predetermined transfer function.

12. The speaker driving device according to claim 9, wherein it is possible to set so that the first parameter and the second parameter are the same.

13. The speaker driving device according to claim 9, wherein it is possible to set so that the third parameter and the fourth parameter are the same.

14. The speaker driving device according to claim 9, wherein the first calculation signal includes information related to a position of a diaphragm of the first speaker unit, the second calculation signal includes information related to a position of a diaphragm of the second speaker unit, the third calculation signal includes information related to a position of a diaphragm of the third speaker unit, and the fourth calculation signal includes information related to a position of a diaphragm of the fourth speaker unit.

* * * * *